US008739659B2

(12) United States Patent
Chen

(10) Patent No.: US 8,739,659 B2
(45) Date of Patent: Jun. 3, 2014

(54) RATCHET WRENCH

(76) Inventor: Yu-Tang Chen, Taichung (TW)

( * ) Notice: Subject to any disclaimer, the term of this patent is extended or adjusted under 35 U.S.C. 154(b) by 303 days.

(21) Appl. No.: 13/409,068

(22) Filed: Feb. 29, 2012

(65) Prior Publication Data

US 2013/0220082 A1 Aug. 29, 2013

(51) Int. Cl.
*B25B 13/46* (2006.01)
*B25B 13/00* (2006.01)

(52) U.S. Cl.
USPC ..... 81/63; 81/124.3

(58) Field of Classification Search
USPC ..... 81/58.1, 58.2, 120, 121.1, 63, 124.3
See application file for complete search history.

(56) References Cited

U.S. PATENT DOCUMENTS 686,237 A * 11/1901 McKim ..... 81/57.39
1,078,059 A * 11/1913 Mossberg ..... 81/63
3,927,582 A * 12/1975 Hertelendy et al. ..... 81/58.2
5,960,681 A * 10/1999 Anderson et al. ..... 81/125
5,983,758 A * 11/1999 Tanner ..... 81/124.3
7,228,764 B1 * 6/2007 Macor ..... 81/121.1
2001/0054334 A1 * 12/2001 Ling et al. ..... 81/124.3
2007/0151425 A1 * 7/2007 Macor ..... 81/121.1
2007/0277652 A1 * 12/2007 Tuan-Mu ..... 81/63
2008/0289455 A1 * 11/2008 Goss ..... 81/121.1

* cited by examiner

*Primary Examiner* — Monica Carter
*Assistant Examiner* — Melanie Alexander

(57) ABSTRACT

A ratchet wrench includes a wrench body having a circular space defined at a head portion of the wrench body, a ratchet with a hollow center placed into the circular space. The ratchet is symmetric to the wrench body. The inner wall of the ratchet has a plurality of first ridges formed thereon. A first recess is formed between each of two adjacent first ridges. Each of the first recesses selectively has a second ridge formed thereon. A second recess is defined on the second ridge. The shape of the second recess is as same as the first recess. In this way, a user can directly alternate the big and small bolts in the ratchet wrench, rather than turn over the wrench to fit the big or small bolt.

2 Claims, 6 Drawing Sheets

RATCHET WRENCH

BACKGROUND OF THE INVENTION

1. Field of the Invention

The present invention relates to a ratchet wrench, more particularly to a ratchet wrench with an easy alternative structure, in which a user can directly alternate the big and small bolts in the ratchet wrench, rather than turn over the wrench to fit the big or small bolt.

2. Description of Related Art

A conventional ratchet wrench comprises a wrench body with a round head portion, a ratchet assembled to the head portion of the wrench body. The ratchet has a first space defined at one side and a second space defined at another side. The diameter of the first space is larger than the diameter of the second space. If a user wants to alternate one small bolt for the task, the user needs to turn over the ratchet wrench so that the second space can clamp the small bolt and the user can continue the task. However, the bolts are easily to fall down and to get lost when the ratchet wrench is turning. In addition, the head portion of the big bolt cannot exceed into the second space or the head portion of the small bolt cannot exceed into the first space. It leads to that the total length from the ratchet wrench to the thread end of the bolt is too long to work in a narrow area.

The present invention has arisen to mitigate and/or obviate the disadvantage of the conventional.

SUMMARY OF THE INVENTION

The main objective of the present invention is to provide an improved ratchet wrench with an easy alternative structure, in which a user can directly alternate the big and small bolts in the ratchet wrench, rather than turn over the wrench to fit the big or small bolt.

To achieve the objective, a ratchet wrench comprises a wrench body having a circular space defined at a head portion of the wrench body, a ratchet with a hollow center placed into the circular space, the ratchet extending out of the two sides of the wrench body, the ratchet being symmetric to the wrench body, a plurality of annular teeth formed along the peripheral of the ratchet corresponding to the circular space, the inner wall of the ratchet having a plurality of first ridges formed thereon, a first recess formed between each of two adjacent first ridges, each of the first recesses selectively having a second ridge formed thereon, a second recess defined on each of the second ridges, the shape of the second recess as same as the first recess, two stopper portions orthogonally formed between each of the first recesses and the second ridges, the two stopper portions respectively located at two ends of the second ridge, a switch device assembled to the head portion of the wrench body, the switch device including a pawl and a positioning member, the pawl engaged with the annular teeth of the ratchet so as to limit the rotating direction of the ratchet, the pawl locked by the positioning member so as to prevent the pawl rotating from one unexpected direction.

The amount of the second ridges is less than the amount of the first ridges.

The second embodiment of the ratchet wrench comprises only two second ridges which are faced to each other in the ratchet. In this way, the manufacturer can save time and money to produce the ratchet wrench.

Further benefits and advantages of the present invention will become apparent after a careful reading of the detailed description with appropriate reference to the accompanying drawings.

BRIEF DESCRIPTION OF THE DRAWINGS

FIG. 4 is a front side view for showing the small bolt to be screwed by the ratchet wrench;

DETAILED DESCRIPTION OF THE INVENTION

Figure 1:
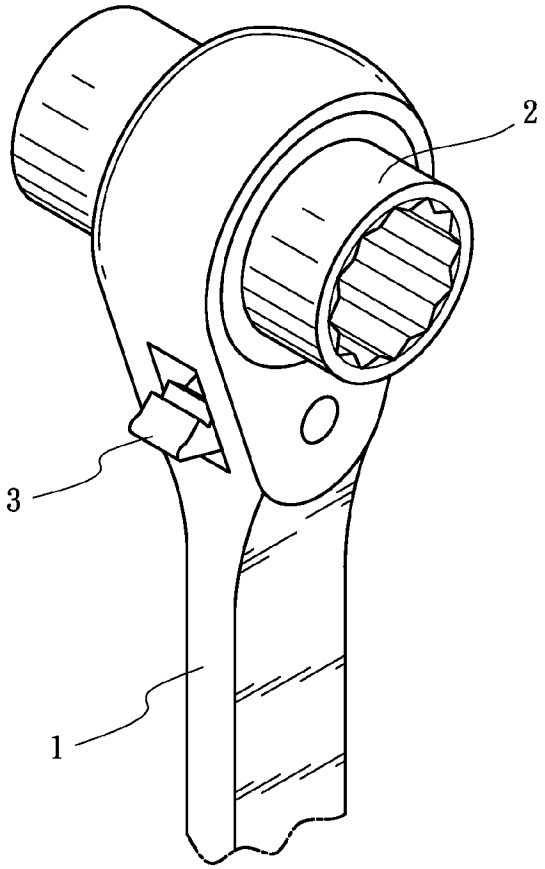
FIG. 1 is a perspective view of a ratchet wrench in accordance with the present invention.
Figure 2:
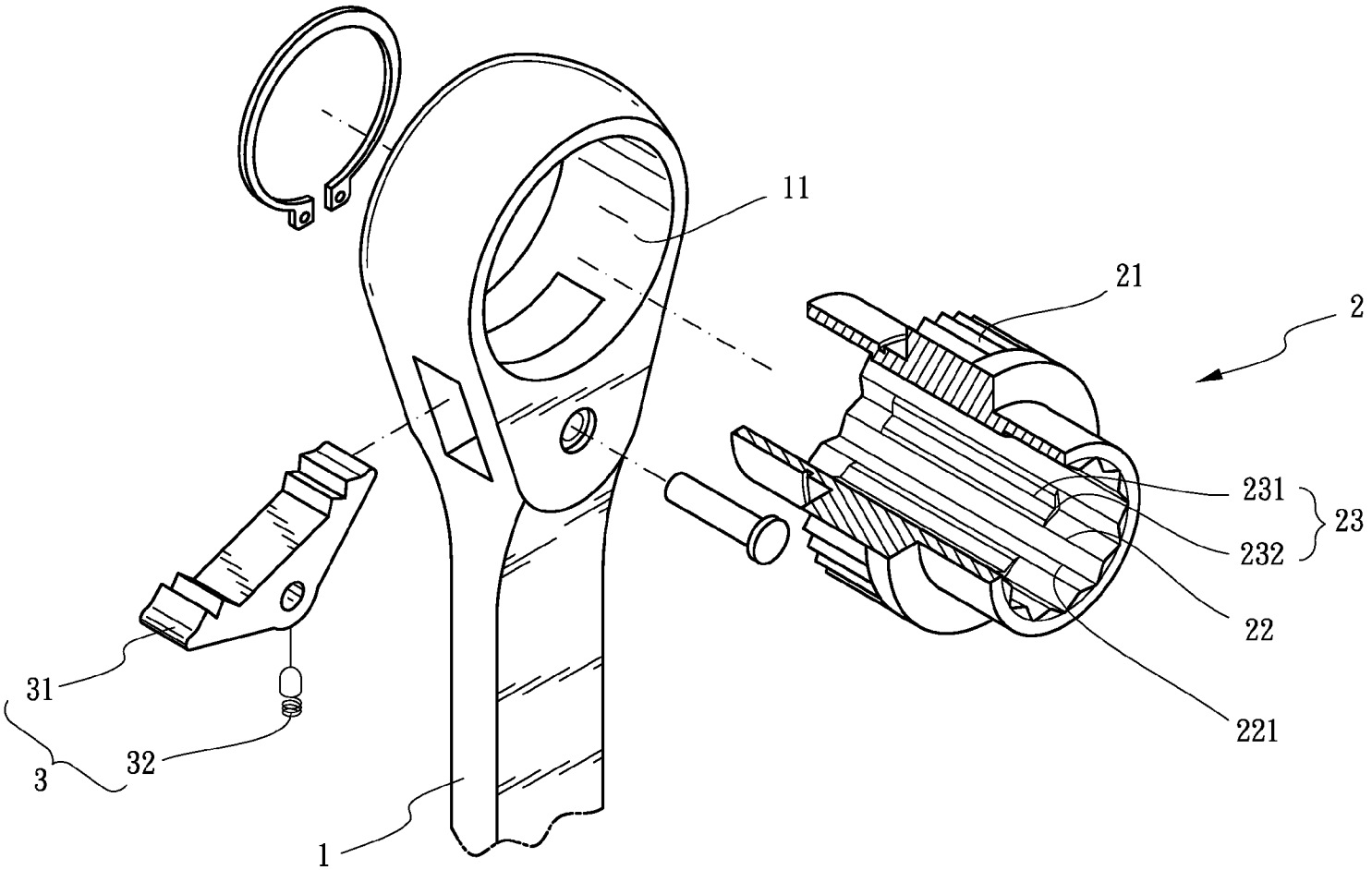
FIG. 2 is an exploded view of the ratchet wrench in accordance with the present invention.

Referring to the FIGS. 1-2, a ratchet wrench in accordance with the present invention comprises a wrench body 1, a ratchet 2 with a hollow center and a switch device 3.

The wrench body 1 has a circular space 11 defined at a head portion of the wrench body 1. The ratchet 2 is placed into the circular space 11. The ratchet 2 is extending out of the two sides of the wrench body 1. The ratchet 2 is symmetric to the wrench body 1. A plurality of annular teeth 21 are formed along the peripheral of the ratchet 2 corresponding to the circular space 11. The inner wall of the ratchet 2 has a plurality of first ridges 22 formed thereon. A first recess 221 is formed between each of two adjacent first ridges 22. Each of the first recesses 221 selectively has a second ridge 23 formed thereon. A second recess 231 is defined on each of the second ridges 23. The shape of the second recess 231 is as same as the first recess 221. The amount of the second ridges 23 is less than the amount of the first ridges 22. Two stopper portions 232 are orthogonally formed between each of the first recesses 221 and the second ridges 23. The two stopper portions 232 are respectively located at two ends of the second ridge 23. The switch device 3 is assembled to the head portion of the wrench body 1. The switch device 3 includes a pawl 31 and a positioning member 32. The pawl 31 is engaged with the annular teeth 21 of the ratchet 2 so as to limit the rotating direction of the ratchet 2. The pawl 31 is locked by the positioning member 32 so as to prevent the pawl 31 rotating from one unexpected direction. Under the above arrangement, a user can directly alternate the big and small bolts in the ratchet wrench, rather than turn over the wrench to fit the big or small bolt.

Figure 4:
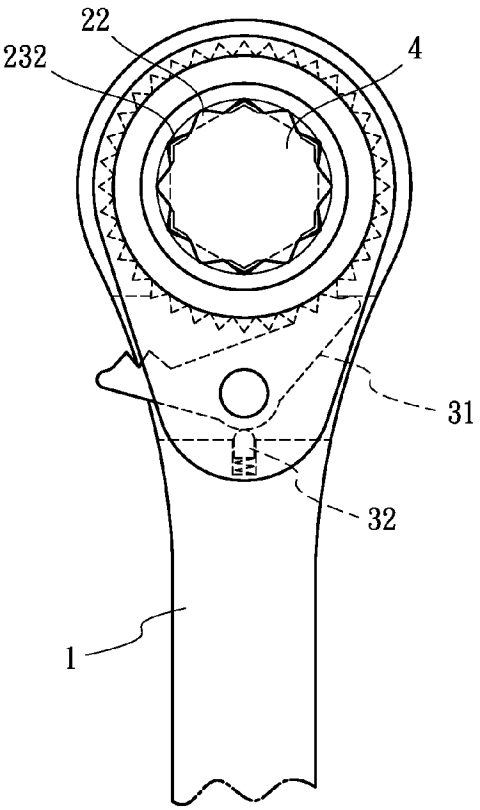
FIG. 4 is a front side view for showing the big bolt to be screwed by the ratchet wrench.
Figure 3:
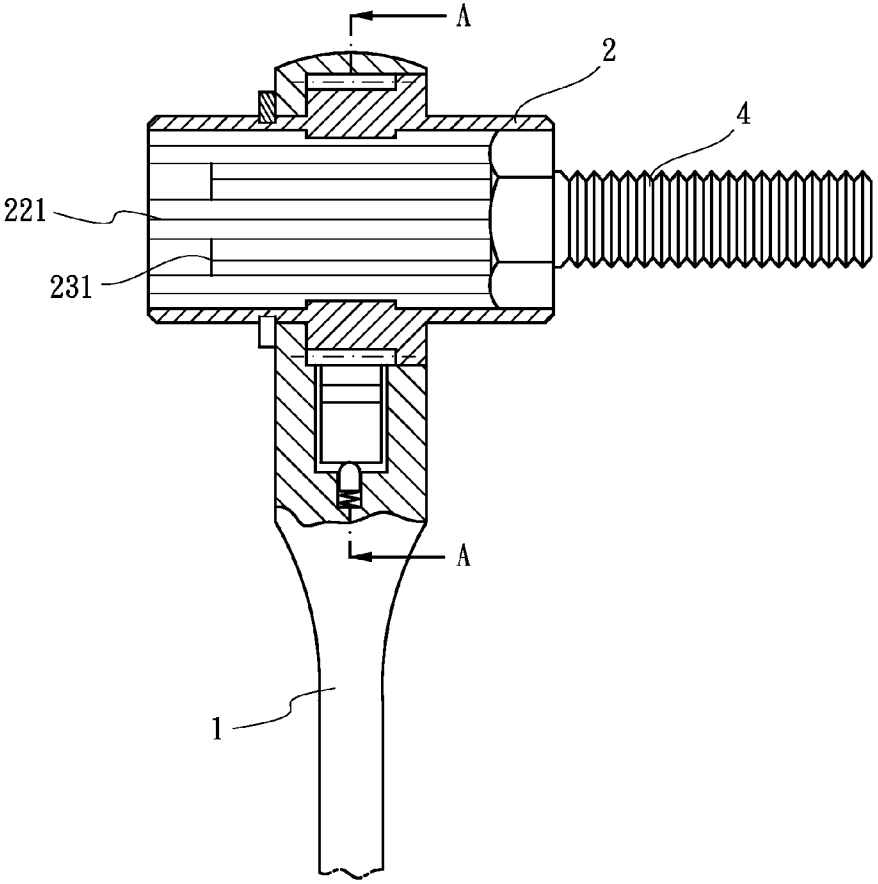
FIG. 3 is a cross-sectional view of the ratchet wrench with a big bolt.

Referring to FIGS. 3-4, when the user screws a big bolt 4 by the ratchet wrench, the head of the big bolt 4 is clamped in the first recesses 221 by the ratchet 2. The head of the big bolt 4 is abutted against the stopper portion 232. Therefore, when the user rotates the wrench body 1, the annular teeth 21 of the ratchet are boosted by the switch device 3 in one direction and the big bolt 4 is rotated by the ratchet 2 simultaneously to be attached on or detached off.

Figure 6:
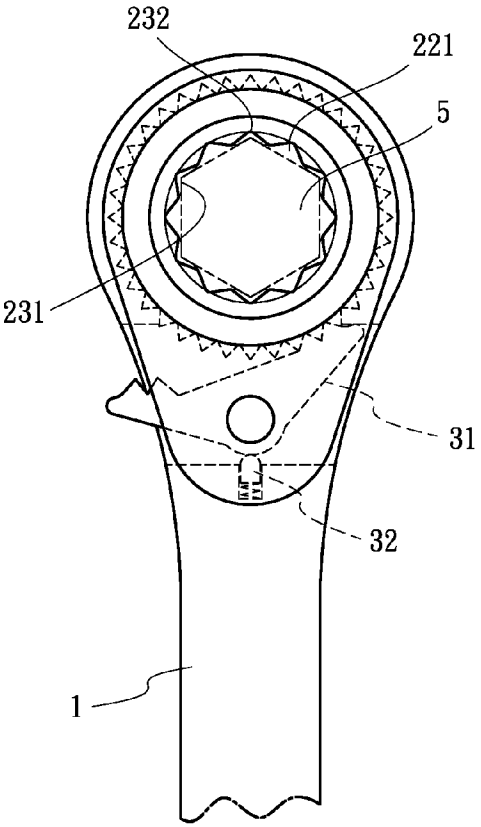
Figure 5:
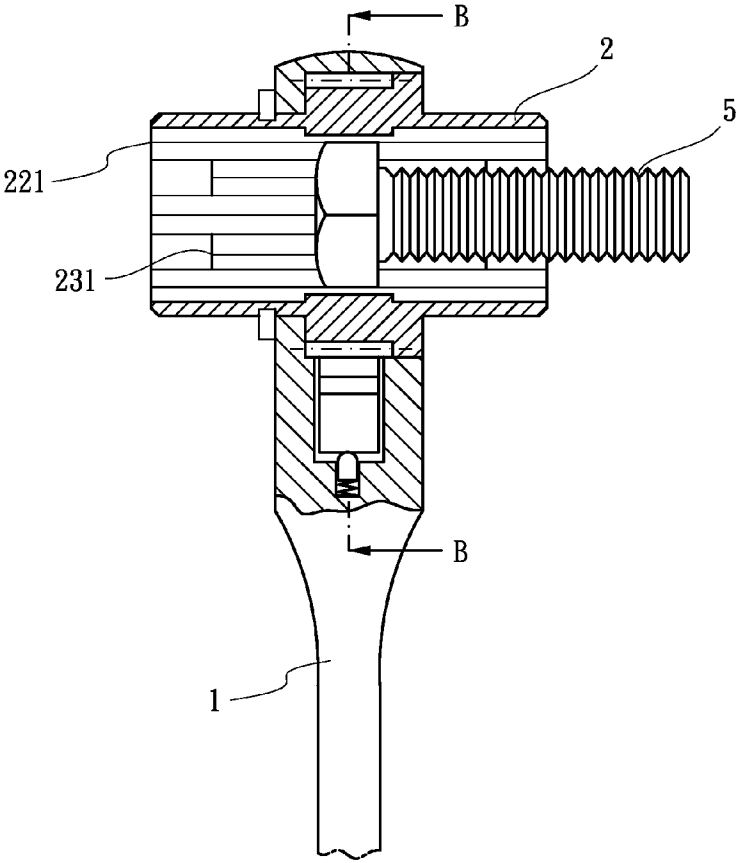
FIG. 5 is a cross-sectional view of the ratchet wrench with a small bolt.

Referring to FIGS. 5-6, when the user screws a small bolt 5 by the ratchet wrench, the head of the small bolt 5 is clamped in the second recesses 221 by the ratchet 2. The head of the small bolt 5 is tightly engaged with the second ridges 23. Therefore, when the user rotates the wrench body 1, the annular teeth 21 of the ratchet are boosted by the switch device 3 in one direction and the small bolt 5 is rotated by the ratchet 2 simultaneously to be attached on or detached off.

Figure 8:
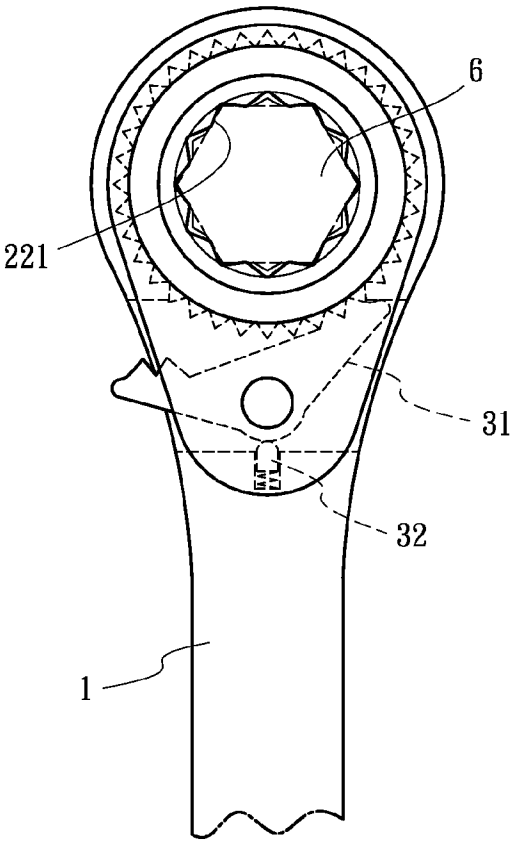
FIG. 8 is a front side view for showing the long bolt to be screwed by the ratchet wrench.
Figure 7:
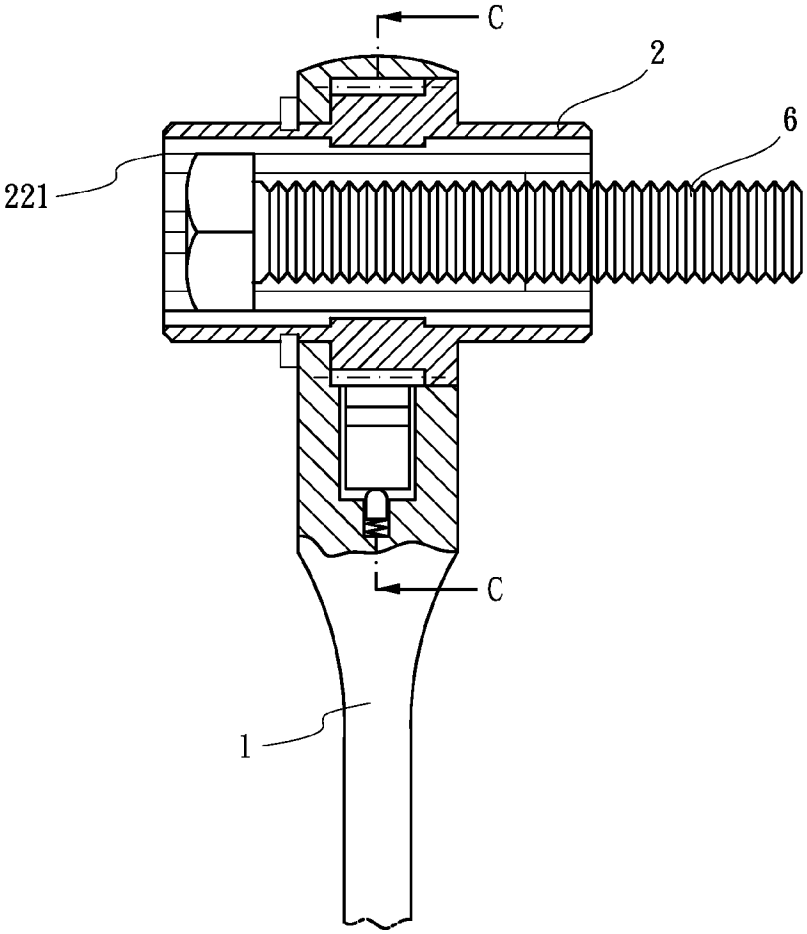
FIG. 7 is a cross-sectional view of the ratchet wrench with a long bolt.

Referring to FIGS. 7-8, if the bolt 6 is too long to screw in a narrow area, the thread portion of the bolt can be received into the ratchet 2 for the user to work in the narrow area (This characteristic is not only used to the small bolt as shown in FIGS. 7-8, but also the big bolt which in not shown in the drawings).

Figure 9:
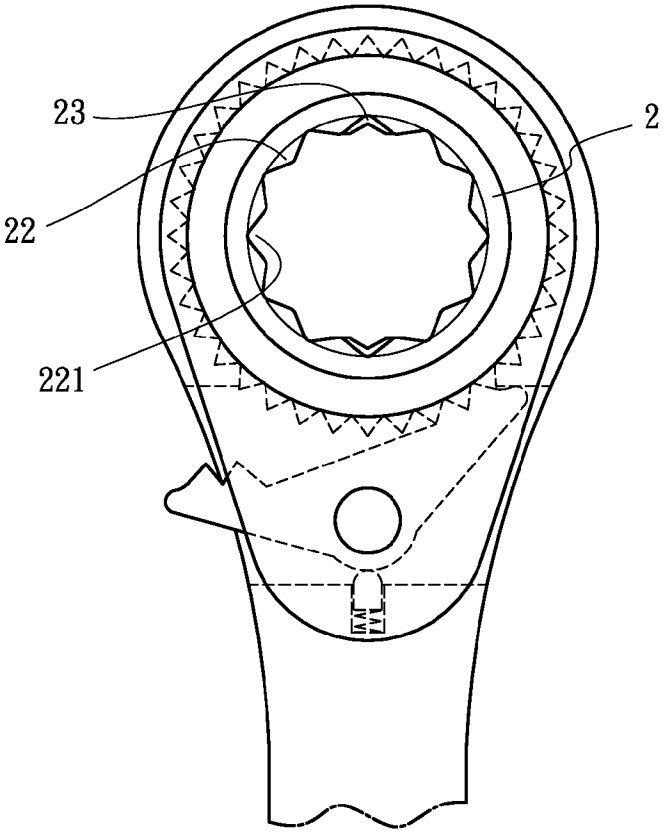
FIG. 9 is a front side view of the second embodiment in accordance with the present invention.

Referring to FIG. 9, the second embodiment of the ratchet wrench comprises only two second ridges 23 which are faced to each other in the ratchet 2. In this way, the manufacturer can save time and money to produce the ratchet wrench.

Although the invention has been explained in relation to its preferred embodiment, it is to be understood that many other possible modifications and variations can be made without departing from the spirit and scope of the invention as hereinafter claimed.

What is claimed is:

1. A ratchet wrench comprising:

a wrench body having a circular space defined at a head portion of the wrench body;

a ratchet with a hollow center placed into the circular space, the ratchet having a middle portion and opposing first and second end portions extending out of two sides of the wrench body, the first and second end portions of the ratchet being symmetric to each other to have the same size for engagement with same sized work pieces, a plurality of annular teeth formed along the peripheral of the ratchet corresponding to the circular space, the inner wall of the ratchet having a plurality of first ridges axially extending from the first end portion through the middle portion to the second end portion of the ratchet, a first recess formed between each of two adjacent first ridges, every adjacent two of the first recesses having a relatively shorter second ridge formed in the respective first recess and along the middle portion of the ratchet, a second recess defined on each of the second ridges, and the shape of the second recess the same as the first recess in such a way that the middle portion of the ratchet is able to engage and drive a relatively smaller sized work piece when the smaller sized work piece is inserted into the middle portion of the ratchet from either the first or second end portion of the ratchet, two stopper portions orthogonally formed between each of the first recesses and the second ridges, the two stopper portions respectively located at two ends of the second ridge; and a switch device assembled to the head portion of the wrench body, the switch device including a pawl and a positioning member, the pawl engaged with the annular teeth of the ratchet so as to limit the rotating direction of the ratchet, the pawl locked by the positioning member so as to prevent the pawl rotating from one unexpected direction.

2. A ratchet wrench comprising:

a wrench body having a circular space defined at a head portion of the wrench body;

a ratchet with a hollow center placed into the circular space, the ratchet having a middle portion and opposing first and second end portions extending out of two sides of the wrench body, the first and second end portions of the ratchet being symmetric to each other to have the same size for engagement with the same sized work pieces, a plurality of annular teeth formed along the peripheral of the ratchet corresponding to the circular space, the inner wall of the ratchet having a plurality of first ridges axially extending from the first end portion through the middle portion to the second end portion of the ratchet corresponding to the same sized work pieces, a first recess formed between each of two adjacent first ridges, only two relatively shorter second ridges being formed on two of the first recesses and along the middle portion of the ratchet, a second recess defined on each of the second ridges, and the shape of the second recess the same as the first recess in such a way that the middle portion of the ratchet is able to engage and drive a relatively smaller sized work piece when the smaller work piece is inserted into the middle portion of the ratchet from either the first or second end portion of the ratchet, two stopper portions orthogonally formed between each of the first recesses and the second ridges, the two stopper portions respectively located at two ends of the second ridge; and a switch device assembled to the head portion of the wrench body, the switch device including a pawl and a positioning member, the pawl engaged with the annular teeth of the ratchet so as to limit the rotating direction of the ratchet, the pawl locked by the positioning member so as to prevent the pawl rotating from one unexpected direction.

* * * * *